United States Patent [19]

Helinski

[11] 4,359,937

[45] Nov. 23, 1982

[54] DOT MATRIX PRINTER

[75] Inventor: Edward F. Helinski, Johnson City, N.Y.

[73] Assignee: International Business Machines Corporation, Armonk, N.Y.

[21] Appl. No.: 261,396

[22] Filed: May 7, 1981

[51] Int. Cl.[3] ..... B41J 3/12

[52] U.S. Cl. ..... 101/93.04; 101/93.09

[58] Field of Search ..... 101/93.04, 93.05, 93.09; 400/121, 124

[56] References Cited

U.S. PATENT DOCUMENTS

| | | | |
|---|---|---|---|
| 3,698,529 | 10/1972 | Cattaneo | 197/49 |
| 3,701,995 | 10/1972 | Staller | 101/93.04 |
| 3,715,978 | 2/1973 | Raider | 101/93.09 |
| 3,719,139 | 3/1973 | Niccolai | 101/93 C |
| 3,773,161 | 11/1973 | Bossi | 197/49 |
| 4,218,149 | 8/1980 | Okada | 400/124 |
| 4,278,019 | 7/1981 | Meier | 101/93.04 |

OTHER PUBLICATIONS

U.S. patent application "Actuator Mechanism for a Printer Or The Like", filed 11/17/80, Ser. No. 207,503.

*Primary Examiner*—Paul T. Sewell
*Assistant Examiner*—Daniel J. Roock
*Attorney, Agent, or Firm*—Gerald R. Gugger

[57] ABSTRACT

A dot matrix printer is provided which has a row of hammer elements having horizontal impactor bars aligned at upper and lower levels and in partial overlapping relation with adjacent impactor bars. A row of print elements is also provided which alternately have horizontal upper and lower level non-overlapping impact receiving bars positioned opposite the hammer elements and in alignment with corresponding upper and lower impactor bars. Each print element has a dot print element on its opposite side and the row of print elements is mounted on a reciprocating shuttle. Means are provided for actuating the hammer elements whereby selected hammer impactor bars will impact the impact receiving bars to effect transverse deflection of the print elements to form dot impressions on a print medium.

2 Claims, 6 Drawing Figures

DOT MATRIX PRINTER

BACKGROUND OF THE INVENTION

1. Field of the Invention

This invention relates to impact printing and in particular to impact printers in which dots are recorded on a print medium to form images, lines, symbols or the like.

2. Discussion of the Prior Art

In a dot matrix printer, which in some cases may also be referred to as an all-points addressable dot printer, individual dots are recorded selectively at all addressable point positions in a continuous line of dots extending across a record medium. In order to produce recorded images of good print quality, the recorded dots must be precisely located and uniformly spaced at all addressable points of the line and it is desirable to be able to record successions of spaced dots as closely together as possible.

In the multiple blade and helix printers of the type for printing characters, a separation or gap exists between the print elements or type-carrying elements to permit interference-free individual operation. To enhance interference-free individual operation, the prior art shows the use of an over-under hammer and print element structure. This type of structure generally involves the use of carrier elements having engraved characters on the front side and projections alternatively arranged on two levels on the backside, with respect to the print medium. The carrier elements are mounted for movement along a print line. Hammers for striking the projections are arranged in superimposed fashion in two rows, one row being on an upper level and the other row being on a lower level.

U.S. Pat. No. 3,698,529 describes a back-printer using a stationary interposer with over-under projections that are acted on by hammers which move on a carriage and uses a wheel containing engraved characters which moves along with the hammers to accomplish serial printing. This arrangement would be unsatisfactory for use as a dot matrix line front printer which must print using a plurality of hammers simultaneously. Also, there is difficulty in moving the relatively massive hammers.

U.S. Pat. No. 3,719,139 describes a high-speed printer wherein the type-carrying member is provided with staggered rows of projections (over-under) on the reverse side of each type character and wherein a plurality of hammers operating at a print position selectively cooperate with the projections of a respective row. Both the type carrying members and the hammers are moved and the printing elements are presented in sequence to carry out serial printing. This arrangement would not be adaptable for use as a dot matrix printer wherein many positions are printed simultaneously.

U.S. Pat. No. 3,773,161 describes a high speed on-the-fly serial printer wherein character printing is accomplished one character at a time along a succession of printing positions. A print carriage is movable from one printing position to the next. A pair of printing hammers are mounted on the printing carriage and they are arranged on two levels so that the two printing heads are partially overlapping. This arrangement would also be unsatisfactory for use as a dot matrix line front printer which must print many positions simultaneously. Also, it is desirable to have hammers which are stationery.

The over-under hammer and print element structures in the above prior art are satisfactory to permit interference-free individual operation. The blade separation presents little problem for character printing since such printing naturally requires some separation between characters for legibility. However, in the all-points addressable printing of dots, the present invention uses a plurality of fixed cantilevered hammer elements which co-act with a plurality of cantilevered print elements which are mounted on a reciprocating shuttle. With the use of a reciprocating shuttle, it became apparent that an over-under arrangement for the hammer elements and print elements was required which would prevent interaction between adjacent print elements and which also would prevent the crashing between impactor bars and impact receiving bars when the shuttle reached the end of its movement in one direction and then reversed to move in the opposite direction.

SUMMARY OF THE INVENTION

In a preferred embodiment of the present invention, there is provided a dot matrix printer having a row of fixed uniformly spaced cantilevered hammer elements. The hammer elements alternately have horizontal impactor bars aligned at upper and lower levels in an over-under fashion, and in partial overlapping relation with adjacent impactor bars. A row of uniformly spaced cantilevered print elements are provided which have upper and lower non-overlapping horizontal impact receiving bars aligned at upper and lower levels, in an over-under fashion, and positioned opposite the hammer elements and which are impacted by corresponding upper and lower level impactor bars on the hammer elements for transverse deflection to form dot impressions on print lines of a print medium. The print elements have dot producing print elements thereon which face the print medium. A row of suitable hammer magnets is provided for actuating the hammer elements.

The hammer elements are fixed and have no horizontal movement, whereas, the print elements are mounted on a horizontally reciprocating shuttle which is driven back and forth by a cam mechanism whereby the print element impact receiving bars move back and forth across the hammer element impactor bars. The shuttle moves horizontally, in either direction, a distance which is only slightly greater than one dot pitch which is the center-to-center distance between dots. There are a pair of hammer magnets provided for each hammer element and a dot producing element on each print element. As the shuttle moves back and forth, the hammer elements may act on the print elements at anytime to produce dots on the print medium at horizontal positions which are predetermined by suitable control logic. This is accomplished by providing overlapping of the over-under arrangement of the impactor bars on the hammer elements. The position of the shuttle may be sensed by emitter signals which can be produced by an optical or magnetic emitter means. An ink ribbon is provided between the dot producing elements and the print medium, such as, paper which is supported and is indexed vertically by an indexing platen or other suitable means.

In all cases, the reciprocating impact receiving bars on the print elements never move horizontally off of its corresponding impactor bars on the hammer elements. This is very desirable since it precludes the nipping problem that is applicable to printers having hammers which act on dot producing elements that move serially in front of the hammers. Also, sufficient overlap of the impactor bars is provided to assure that when the last print position is passed, that all print elements impact receiving bars do not fall off the edge of the impactor bars on the corresponding hammer elements. This prevents crashing between the impactor and impact receiving bars upon reversal of shuttle motion. And because the impactor bars on the hammer elements are arranged in an over-under fashion, no interaction will take place due to the actuation of adjacent hammer elements.

Accordingly, a primary object of the present invention is to provide a novel and improved dot matrix printer.

Another object of the present invention is to provide an improved dot matrix printer which comprises a row of fixed hammer elements and a row of print elements mounted on a reciprocating shuttle.

A further object of the present invention is to provide an improved dot matrix printer which comprises a novel over-under hammer element and print element structure.

A still further object of the present invention is to provide an improved dot matrix printer which comprises a row of fixed spring hammer elements alternately having horizontal impactor bars aligned at upper and lower levels and in partial overlapping relation with adjacent impactor bars, and a row of reciprocating spring print elements alternately having upper and lower non-overlapping impact receiving bars positioned opposite the hammer elements for being impacted by corresponding alternate upper and lower impactor bars on the hammer elements for transverse deflection to form dot impressions on a print medium.

The foregoing and other objects, features and advantages of the invention will be apparent from the following more particular description of a preferred embodiment of the invention, as illustrated in the accompanying drawings.

DESCRIPTION OF PREFERRED EMBODIMENT

Figure 1:
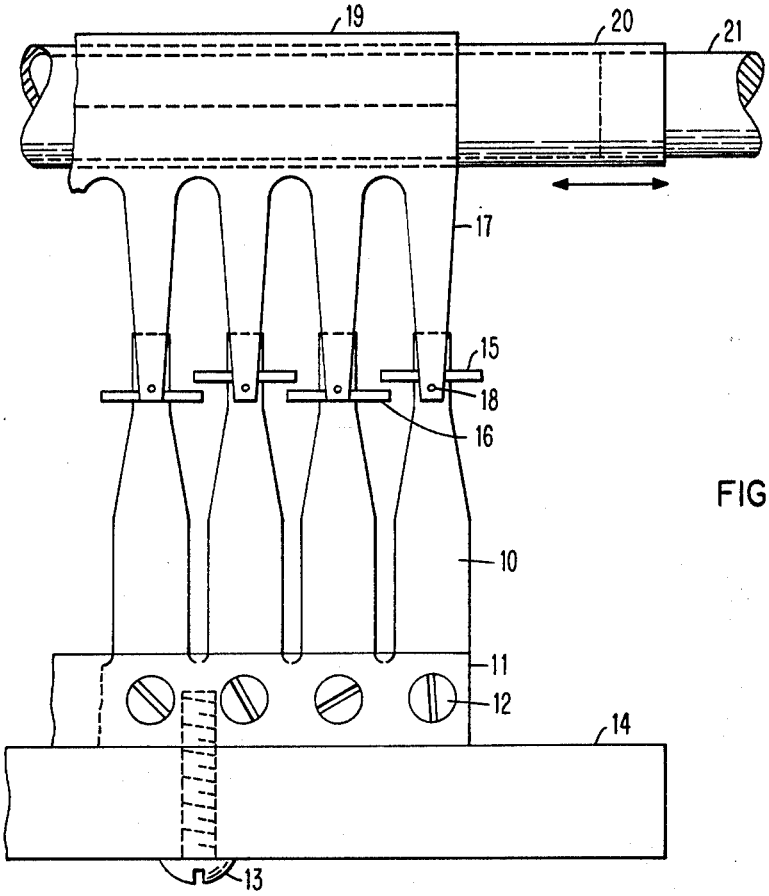
FIG. 1 is an enlarged partial front view of the hammer element and print element arrangement of the present invention showing the front sides of the hammer elements and the overlapping over-under arrangement of the impactor bars thereon and also showing the front sides of the print elements with the dot print elements thereon.
Figure 2:
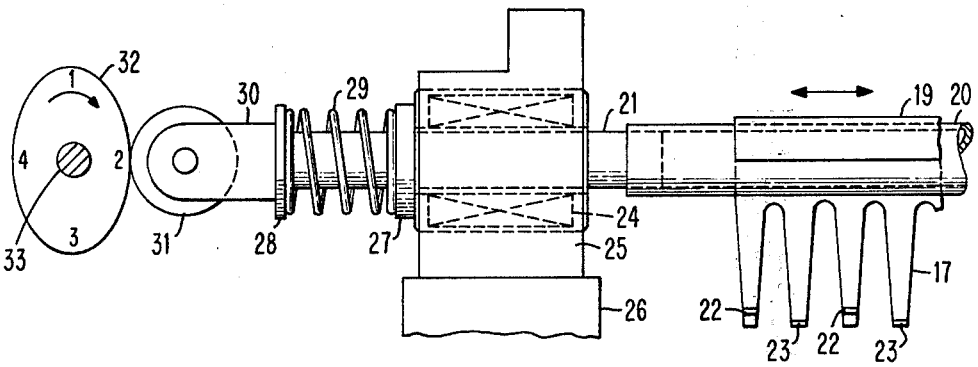
FIG. 2 is a full scale view showing the back sides of the print elements and showing the non-overlapping over-under arrangement of the impact receiving bars thereon and also showing the cam mechanism for reciprocating the print blades.

Referring to FIGS. 1 and 2, there is shown the hammer element and spring element arrangement of the present invention. The arrangement comprises a row of uniformly spaced cantilevered hammer elements 10 which are fixed at one end in the manner of elastic cantilever beams by a suitable means such as clamping plate 11 and screws 12. The plate 11 and screws 12 attach the bottom strip portion of the hammer elements to the base of a hammer magnet assembly which will be later described. The hammer magnet assembly is attached by screws 13 to a support bar 14 which is suitably attached to the machine frame. Although only a few hammer elements are shown, it will be understood that the row could comprise any number of elements depending upon the printing requirement. For example, in one printing application, there would be 45 hammer elements used. The hammer elements are preferably fabricated from a single sheet of magnetically premeable material such as 8620 steel.

Arranged on an upper level is a row of protruding impactor bars 15, there being one impactor bar 15 welded to the front side of each one of alternate hammer elements. Also, arranged on a lower level is a row of similar protruding impactor bars 16, there being one impactor bar 16 welded to the front side to each one of the other alternate hammer elements. This is referred to as an over-under arrangement. It will be noted that the impactor bars 15 partially overlap the adjacent impactor bars 16 and that the impactor bars 15 and 16 do not overlap their adjacent hammer elements.

Arranged above the row of hammer elements is a corresponding row of uniformly spaced cantilevered print elements 17 with the lower ends of the print elements partially overlapping their corresponding hammer elements. Attached to the front or printing side of each print element is a dot print element 18 for recording dots on a print medium. The print elements are also preferably fabricated from a single sheet of magnetically permeable material such as 8620 steel. The print elements are fixed at one end in the manner of elastic cantilever beams at uniformly spaced positions by wrapping the base strip portion 19 partially around an elongated hollow cylinder 20 and attaching it thereto. Attached to each end portion of the cylinder 20 is a rod 21. If desired, a single rod could be used which extends through the cylinder and beyond the ends of the cylinder.

Referring to FIG. 2, the print elements 17 of FIG. 1 are now shown flipped over to more clearly show the back sides of the print elements which face the front sides of the hammer elements. Arranged on an upper level is a row of protruding impact receiving bars 22, there being one impact receiving bar 22 welded to the back side of each one of alternate print elements, the bars 22 being aligned opposite to their corresponding upper level impactor bars 15 on the hammer elements. Also, arranged on a lower level is a row of similar impact receiving bars 23, there being one impact receiving bar 23 welded to the back side of each one of the alternate print elements, the bars 23 being aligned opposite to their corresponding lower level impactor bars 16 on the hammer elements. Upper and lower level bars 22 and 23 do not overlap each other.

Also, shown in FIG. 2 is the cam mechanism for reciprocating the cylinder 20 and rods 21 which form a shuttle to which the print elements are fixed. The rod 21 at one end of the cylinder extends through the ball and sleeve portion 24 of a linear/rotary bearing block 25 and is slideable therein. Bearing block 25 has a base portion 26 which is suitably fastened to the machine frame. Rod 21 extends beyond the bearing block and the end portion of the rod has plate 27 loosely mounted on the rod and also a plate 28 which is fixed on the rod. A compression coil spring 29 is mounted on the rod between the plates 27 and 28. Plate 28 has an arm 30 which rotatably supports a cam follower roller 31. The roller 31 co-acts with the periphery of an elliptical cam 32 fixed on a shaft 33 which is rotated by a suitable motor, not shown. The rod 21 at the other end of the cylinder, not shown in FIG. 2, would also be slideably mounted in a similar linear/rotary bearing block suitably fastened to the machine frame.

As viewed in FIG. 2, the cam follower is forced against the low rise point 2 on the cam by the compression spring. In this position, the spring has driven the shuttle and print elements to the end of their travel to the left. As the cam rotates clockwise, it will cause the cam follower to move toward the right against the force of the compression spring and the contour of the cam is such that the shuttle and print elements will reverse their motion and will first accelerate to a constant velocity and then decelerate until the high rise point 1 on the cam reaches the position previously occupied by the low rise point 2 and in this position the shuttle and print blades will have been driven to the end of their travel toward the right. It can be seen that in similar fashion, further rotation of the cam presents low rise point 4 at which point the shuttle and print elements will have reversed motion and moved all the way toward the left and as high rise point 3 is presented the shuttle and print elements will again reverse motion and move all the way toward the right. Thus, as the cam continuously rotates, the shuttle and print elements will reciprocate back and forth with respect to the hammer elements.

The shuttle does not reverse instantly. The hammer blades and dot print elements are equally spaced. For example, in the present embodiment there is an equal spacing of 0.300 inches between the centers of the dot print elements and between the centers of the hammer elements. The shuttle movement is 0.360 inches for total horizontal travel in each direction and the difference between 0.360 inches and 0.300 inches is to allow for the acceleration and deceleration of the shuttle motion. The normal constant velocity of the shuttle is 20 inches per second. When the last dot printing position is passed, the shuttle is decelerated to a 0 velocity and then accelerated back to its normal velocity in the opposite direction. the cam at the end of the shuttle provides this characteristic motion.

As was previously mentioned, FIG. 2 is a view looking at the back of the print elements. FIG. 1 is a view looking at the front of the print elements and hammer elements in which case the cam mechanism will be at the right-hand end of the assembly and the cam would be rotating counter-clockwise. As a result, the direction of shuttle motion caused by the cam will be the reverse of that just described.

Figure 3:
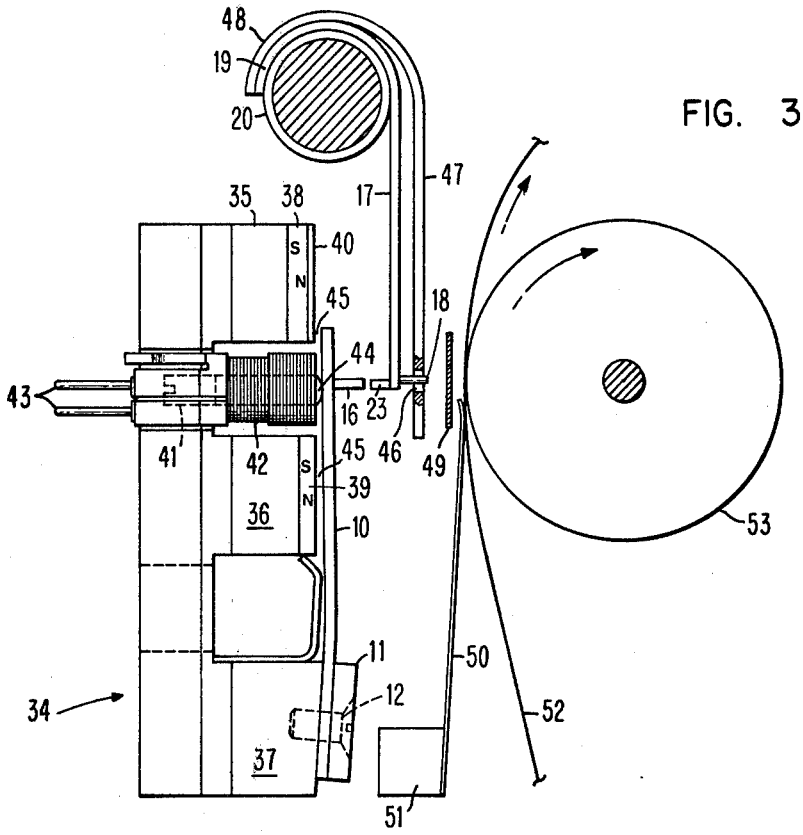
FIG. 3 is an enlarged end view of the hammer element and print element arrangement and the hammer magnet assembly and the print receiving structure.

Referring now to FIG. 3, there is shown an end view of the hammer magnet assembly and the print receiving structure. The hammer magnet assembly is fully shown and described in common assignee's copending application, Ser. No. 207,503, and will be but briefly described here. It should be mentioned at the outset that FIG. 3 shows one magnet assembly for one hammer element. There would be a plurality of identical assemblies arranged in a row, there being one assembly provided for each hammer element. The assembly includes a core means comprising base member 34 having outer pole piece 35, inner pole piece 36 and a support post 37 all of which are constructed of a magnetically permeable material. As was previously mentioned, the flexible hammer element 10 is fixed at one end to the surface of post 37 in the manner of an elastic cantilever beam by means of the clamping plate 11 and screws 12. The surface of post 37 is preferably slanted giving the hammer element 10 in outward print or actuated position when in its unflexed condition.

The hammer element 10 is normally held in a retracted, spring loaded, non-print position, as shown, by magnetic forces produced by two permanent magents 38 and 39 coupled to the faces of the pole pieces 35 and 36. A focusing plate 40 of magnetically permeable material is applied over the outer magnet 38. There is provided a center pole piece 41 of magnetically permeable material which is surrounded by an electric coil 42. Coil 42 is connectable for energization to an external power source via connector pins 43. Center pole piece 41 is located in line with the hammer element position between pole pieces 35 and 36 and extends outwardly from base portion 34 to form an E-core structure. The center pole piece 41 terminates in a pole face covered with a cap 44, of non-magnetic residual material. The center pole piece 41 is made to extend beyond the respective surfaces of focusing plate 40 and inner permanent magnet 39 so that the cap makes contact with the hammer element when in its retracted position so as to maintain an air gap 45 between the focusing plate and hammer element and also between permanent magnet 39 and hammer element.

The permanent magnets 38 and 39 are polarized in the same direction and are supported and magnetically coupled to the E-core structure made up of the base member 34, outer pole piece 35, inner pole piece 36 and the center pole piece 41. The magnetic surface structure produces dual closed magnetic holding circuits for holding the hammer element in spring loaded condition. In the outer magnetic holding circuit, magnetic flux from permanent magnet 38 passes through outer pole piece 35 through base member 34 and returns through center pole piece 41 across cap 44 into the extremity of the hammer element across gap 45 to focusing plate 40. In the second or inner magnetic holding circuit, magnetic flux from permanent magnet 39 passes through inner pole piece 36 and center pole piece 41 into the inner part of the hammer element and across gap 45. The center pole piece 41 provides a common return path for holding flux from both permanent magnets 38 and 39. Because flux from both magnets 38 and 39 passes in the same direction through a common path provided by the center pole piece 41, the selective release of the hammer element is expeditiously performed simply by energizing the coil 42 with current applied through connector pins 43 in the direction which produces a counter flux sufficient for reducing the magnetic holding force of both holding circuits on the flexible extremity of the hammer element.

The hammer element is shown carrying the lower level impactor bar 16 which is in alignment with the lower level impact receiving bar 23 on the flexible print element 17. As was previously described, the print element is partially wrapped around and attached to the shuttle cylinder 20. The front of the print element carrier the dot print element 18 which protrudes through a hole 46 in a steel stripper plate 47 which extends across all of the print elements and has a hole in alignment with each dot print element 18. Stripper plate 47 has a wrapped around portion 48 which is suitably fastened around portion 19 which is then attached to the shuttle cylinder 20. The stripper plate 47 is provided to prevent an ink ribbon 49 from snagging and catching on the dot print elements 18. Ribbon 49 is moved across the print line by means of a conventional reel-to-reel drive, not shown. A thin steel clamp blade 50 is attached to a suitable frame member 51 and the flexible end portion of the blade extends partially between the ribbon 49 and the paper print medium 52 and serves to lightly clamp the paper against the platten 53 to prevent fluffing or rippling of the paper along the print line position. The platen 53 is indexed by suitable indexing means, not shown, to move the paper vertically one print line at a time.

Figure 5:
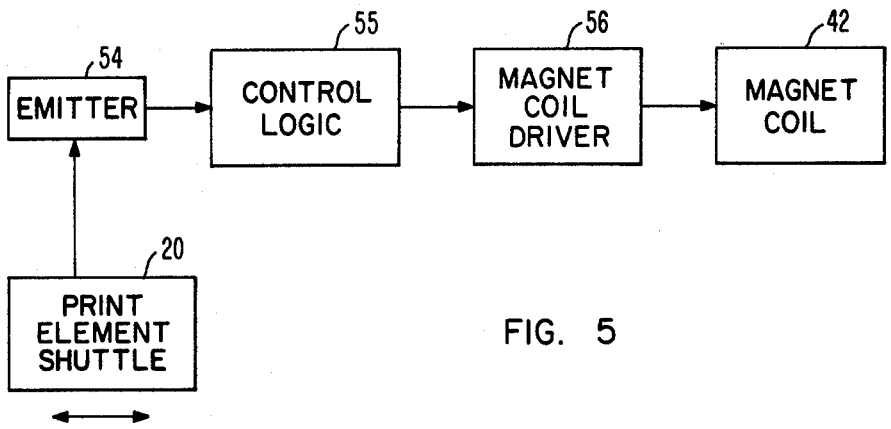
FIG. 5 is a block circuit diagram for effecting selective release of the hammer elements.

Referring to the block diagram shown in FIG. 5, the selective release of the hammer elements to effect printing is accomplished by an emiter 54 which senses the position of the print element shuttle 20. The emitter may comprise either an optical or magnetic emiter means. Emitter signals from the emitter are fed to suitable control logic 55 which determines the position to be printed. The output of the control logic is fed to a magnet coil driver circuit 56 which supplies current to the selected magnet coil 42 to release its associated hammer element.

Figure 4:
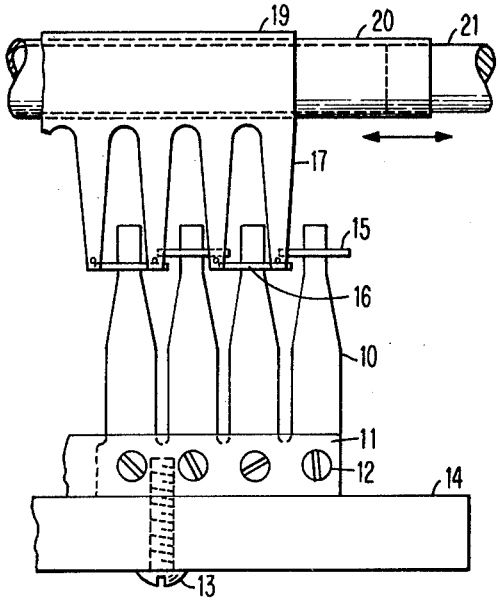
FIG. 4 is a front view similar to FIG. 1 and showing the position of the print elements when the shuttle reaches the end of its travel towards the left, as viewed from the print plane.
Figure 6:
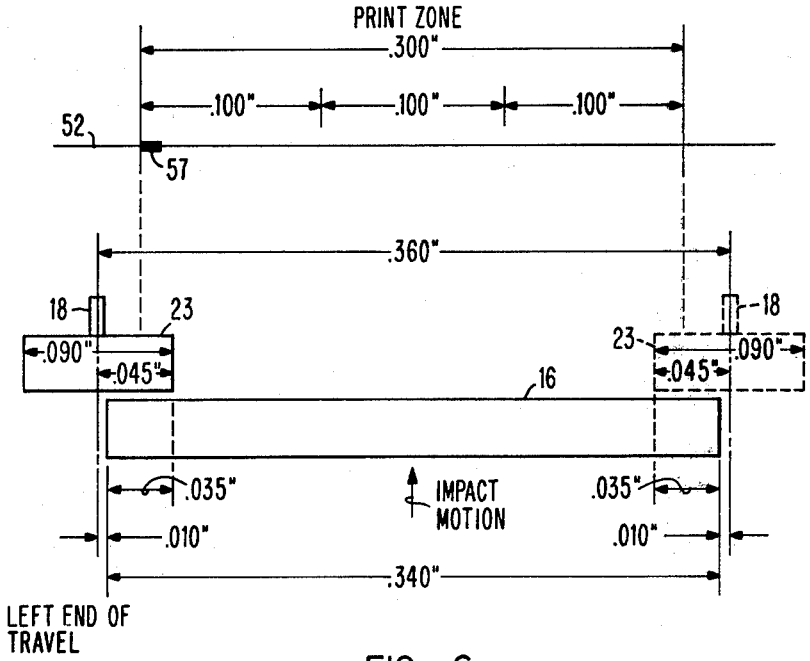
FIG. 6 is a view looking down on the top of an impactor bar, an impact receiving bar, and the top edge of the print paper.

FIG. 4 is a front view similar to FIG. 1 and showing the position of the print elements when the shuttle reaches the end of its travel towards the left, as viewed from the paper plane, and is in position for reverse travel toward the right. Referring now more particularly to FIG. 6, there is shown a view looking down on the top of the lower level impactor bar 16 on the hammer element which is at the left end of the hammer element row and also the top of the corresponding lower level impact receiving bar 23 on the print element which is at the left end of the print element row. In one illustrative example of the arrangement of the present invention, all of the upper and lower level impactor bars have a width of 0.340 inches and all of the upper and lower level impact receiving bars have a width of 0.090 inches. All of the impact receiving bars travel a total distance of 0.360 inches in either direction. The impact receiving bar 23 travels 0.360 inches from its position shown in dotted lines to its stop position shown in solid lines. The 0.360 inches of travel may be considered in terms of including the impactor bar width of 0.340 inches plus 0.010 inches at each end of the bar. As shown, at the left end stop position there is 0.010 inches between the center line of the dot print element 18 and the end of the impactor bar and 0.035 inches of overlap between the end of the impactor bar and the end of the impact receiving bar. The same overlap condition occurs at the right end stop position. In all cases, the reciprocating impact receiving bars on the print elements never move horizontally off of its corresponding impactor bars on the hammer elements to preclude any nipping between the impactor and impact receiving bars. The 0.035 inches overlap provides sufficient overlap to assure that when the last print position is passed, that all print element impact receiving bars do not fall off the edge of the impactor bars on the corresponding hammer elements. This prevents crashing between the impactor and the impact receiving bars upon reversal of shuttle motion. And because the impactor bars on the hammer elements are arranged in an over-under fashion, no interaction will take place due to the actuation of adjacent hammer elements and also good impact is provided at the last dot printing position because the hammer element impactor bar always extends beyond the last dot position to provide the required force for impact.

FIG. 6 also shows a view looking down on the top edge of the print paper 52. In one application of the present invention, a print zone having a width of 0.300 inches is provided for each hammer position. There are 5 print positions for each 0.100 inches of the print zone making 15 print positions for the zone. In the case of a 45 hammer unit, for example, this results in 135 character positions and 675 dot positions across 13.5 inches on the paper. The last print position is indicated at 57 and when the print element 18 passes this position, the cam mechanism will decelerate the shuttle to 0 velocity. This also occurs when the shuttle travels all the way to the right.

In some high speed printer applications where a larger number of hammer elements and print elements may be required, the width of the impactor bars and impact receiving bars could be decreased and the adjacent impact receiving bars arranged to partially overlap each other.

It will be understood that the present invention is not limited to the specific velocity and dimensions described. These factors may be varied to meet the requirements of different printing application.

While the invention has been particularly shown and described with reference to a preferred embodiment thereof, it will be understood by those skilled in the art that various changes in form and details may be made therein without departing from the spirit and scope of the invention.

What is claimed is:

1. A dot matrix printer for forming dot impressions on a print medium which comprises;

a single horizontal row of uniformly spaced cantilevered hammer elements, said hammer elements alternately having horizontal impactor bars aligned at upper and lower levels and in partial overlapping relation with adjacent impactor bars, a single horizontal row of uniformly spaced cantilevered print elements alternately having horizontal upper and lower level non-overlapping impact receiving bars positioned opposite said hammer elements and in alignment with corresponding upper and lower impactor bars, dot print elements on the opposite sides of said print elements, means for effecting horizontal reciprocation of said print elements with respect to said hammer elements, and means for actuating said hammer elements whereby selected hammer impactor bars will impact said impact receiving bars to effect transverse deflection of the print elements to form dot impressions on said print medium.

2. A dot matrix printer as set forth in claim 1 wherein said print elements are mounted on a shuttle, and said reciprocating means effects reciprocation of said shuttle and print elements whereby said impact receiving bars have a horizontal stroke distance which does not exceed the horizontal width of said impactor bars plus the horizontal width of said impact receiving bars.

* * * * *